US005489954A

United States Patent [19]

Field, Jr.

[11] Patent Number: 5,489,954

[45] Date of Patent: Feb. 6, 1996

[54] LENS PROJECTING DEVICE

[75] Inventor: Edgar L. Field, Jr., Muskogee, Okla.

[73] Assignee: Coburn Optical Industries, Inc., Tulsa, Okla.

[21] Appl. No.: 132,642

[22] Filed: Oct. 6, 1993

[51] Int. Cl.[6] ..... G03B 21/26; B24B 41/06

[52] U.S. Cl. ..... 353/119; 356/397; 353/28; 353/122; 451/390

[58] Field of Search ..... 353/119, 28, 100, 353/98, 122, 74, 77, 78, 67, 66, 65, 40–41, 79–80; 356/388, 391, 392, 393, 397, 395; 51/277, 284; 33/507

[56] References Cited

U.S. PATENT DOCUMENTS

| | | | |
|---|---|---|---|
| 4,227,349 | 10/1980 | Bicskei | 51/284 E |
| 4,229,911 | 10/1980 | Bicskei | 51/284 E |
| 4,288,946 | 9/1981 | Bicskei | 51/284 E |
| 4,737,918 | 4/1988 | Langlois et al. | 364/474 |
| 5,231,433 | 7/1993 | Yoshida | 353/37 |
| 5,283,980 | 2/1994 | Lohrenz et al. | 51/165.72 |

FOREIGN PATENT DOCUMENTS

| | | | |
|---|---|---|---|
| 206860 | 12/1986 | European Pat. Off. . | |
| 2115966 | 7/1972 | France . | |
| 1572866 | 2/1970 | Germany . | |
| 3829488 | 3/1990 | Germany . | |
| 4012661A1 | 10/1991 | Germany | G02C 13/00 |
| 0258037 | 4/1949 | Switzerland | 356/391 |

*Primary Examiner*—William A. Cuchlinski, Jr.
*Assistant Examiner*—William C. Dowling
*Attorney, Agent, or Firm*—Frank J. Catalano; Scott R. Zingerman

[57] ABSTRACT

A lens projector is provided for use with a lens blocking device having an LCD target display plane disposed beneath a work surface and a tower having an upper portion extending above the work surface with a eyepiece therethrough. The lens projector includes a bracket fixed to the tower proximate the eyepiece with a light source rigidly seated on the bracket above the work surface. A viewer mounted in the eyepiece is aligned on a sight line substantially normal to and centered on the work center of the LCD target display plane. An at least partially transmissive mirror intersects the sight line and is fixed to the viewer at an angle such that light emitted from a center of the light source is reflected along the sight line toward the work surface so as to project an image of a multi-focal segment or a lens marking onto the graphic display. A shield fixed to the bracket and extending between the light source and the tower protects the tower from heat dissipated by the light source. The projector light source is preferably a high intensity lamp connected to the electrical power source of the blocking device. A switch responsive to operation of a key on a keyboard of the blocking device controls the operation of the lamp and a timer automatically disconnects the lamp from the power source after a preselected period of operation.

11 Claims, 4 Drawing Sheets

LENS PROJECTING DEVICE

BACKGROUND OF THE INVENTION

This invention relates generally to optical equipment and more particularly concerns apparata for projecting a lens blank on a lens blocker.

In Pat. No 5,283,980, a lens blocker was disclosed for use in applying a block on a lens blank in preparation for mounting on a edgar. In using this and other types of lens blockers, it is sometimes desirable to project an image of a low power add of a multi-focal segmented lens on the LCD alignment screen target. It is further sometimes desirable to project or reflect the lay-out markings of a progressive lens as an image on the LCD alignment screen target. Similarly, projection of invisible or blended bifocals may also be desirable.

Most presently known lens projecting devices using LCDs accomplish the projection of low power adds, progressives and bifocals by use of a back light. In a back light arrangement, a lamp beneath the work surface illuminates a lens disposed between the work surface and the light source. Casting the image on the LCD surface with the work area above and the lens below has several draw backs. Since the LCD must be transparent, a unique LCD is required. Manipulation and alignment of the lens becomes difficult because manipulation occurs below the work surface while viewing occurs above the work surface and because the components of the blocker apparatus limit the hand movements of the operator. Moreover, the blocker apparatus so constricts space in the area where the lens must be placed that it is physically impossible to insert, much less manipulate, thicker lenses. One known projecting device deals with the above mentioned orientation problems by placing the lens above the work surface rather than beneath it but this imposes limitations on the viewing of low power multi-focal segments. In an attempt to overcome these limitations, edge lighting is used, but is ineffective in highlighting the multi-focal segments. Furthermore, edge lighting cannot be used to project the image of a dark lens or markings thereon.

It is, therefore, an object of this invention to provide a lens projecting device which projects an accurately defined image on an LCD surface. It is a further object of this invention to provide a lens projecting device which projects an image on an LCD work surface which is accurate when observed from any position above the LCD surface. It is another object of this invention to provide a lens projecting device which permits manipulation of the lens above the work surface of a lens blocking device. Another object of this invention is to provide a lens projecting device which can be used with a standard LCD. It is also an object of this invention to provide a lens projecting device usable with lenses of any thickness.

SUMMARY OF THE INVENTION

In accordance with the invention, a lens projector is provided for use with a lens blocking device having an LCD target display plane disposed beneath a work surface and a tower having an upper portion extending above the work surface with a eyepiece therethrough. The lens projector includes a bracket fixed to the tower proximate the eyepiece with a light source rigidly seated on the bracket above the work surface. A viewer mounted in the eyepiece is aligned on a sight line substantially normal to and centered on the work center of the LCD target display plane. An at least partially transmissive mirror intersects the sight line and is fixed to the viewer at an angle such that light emitted from a center of the light source is reflected along the sight line toward the work surface. A shield fixed to the bracket and extending between the light source and the tower protects the tower from heat dissipated by the light source. The projector light source is preferably a high intensity lamp connected to the electrical power source of the blocking device. A switch responsive to operation of a key on a keyboard of the blocking device controls the operation of the lamp and a timer automatically disconnects the lamp from the power source after a preselected period of operation.

BRIEF DESCRIPTION OF THE DRAWINGS

Other objects and advantages of the invention will become apparent upon reading the following detailed description and upon reference to the drawings in which.

While the invention will be described in connection with a preferred embodiments, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
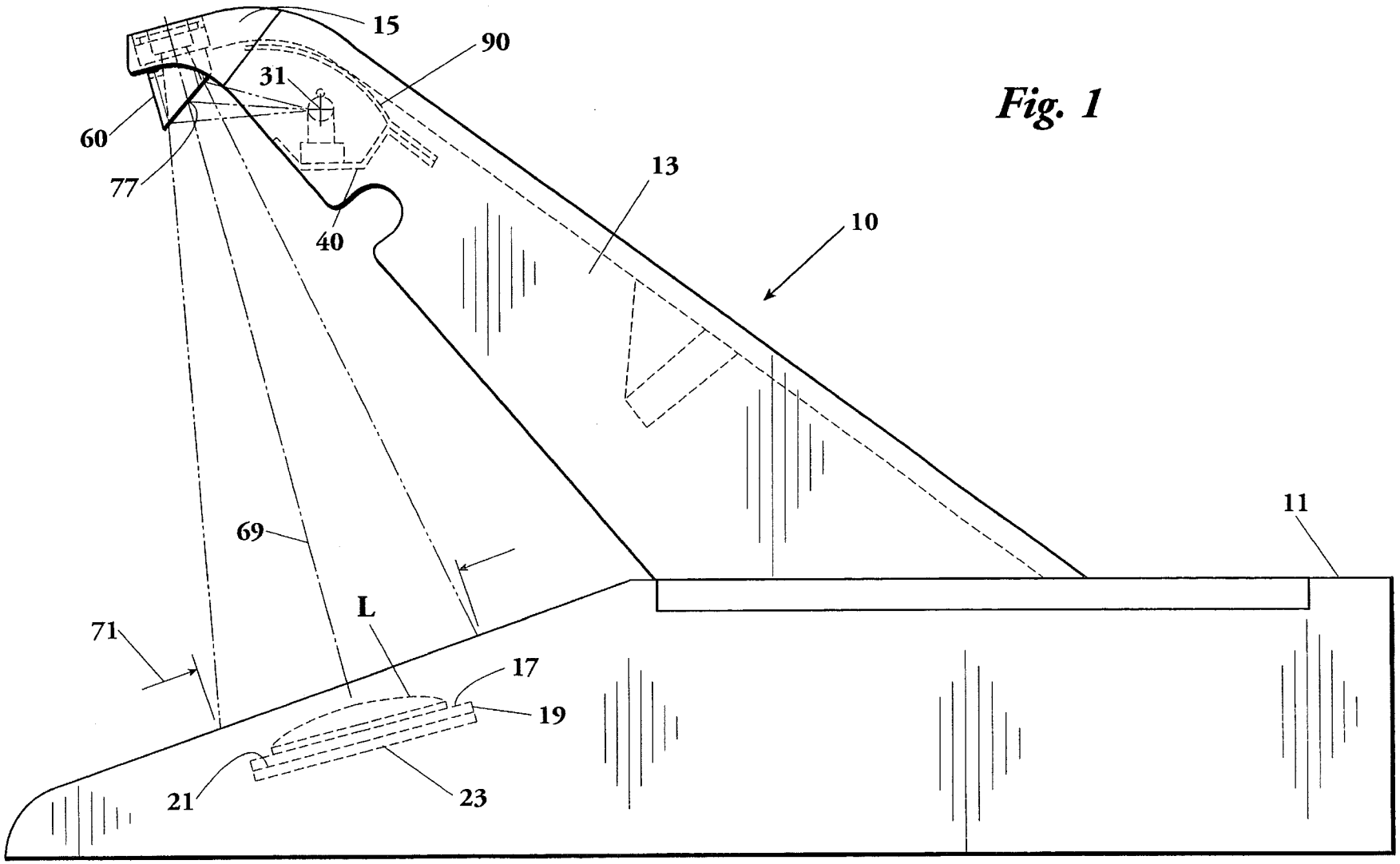
FIG. 1 is a side elevation view of a lens blocker incorporating the lens projecting device of the present invention.

Turning first to FIG. 1, a lens blocker 10 is illustrated, having a support frame 11 from which upwardly and forwardly extends a tower 13 which has an upper portion 15 disposed above a work surface 17 on the front of the blocker 10. The work surface 17 is the top face of a viewing glass 19 which rests on a target display plane 21 of an LCD 23. A blocker of this type is described in greater detail in U.S. Pat. No. 5,283,980.

To facilitate projecting of a lens L resting on the work surface 17 onto the target display plane 21, the blocker 10 is provided with a projecting device consisting of a light source 30, a bracket 40, a viewer 60 and a heat shield 90.

Figure 2:
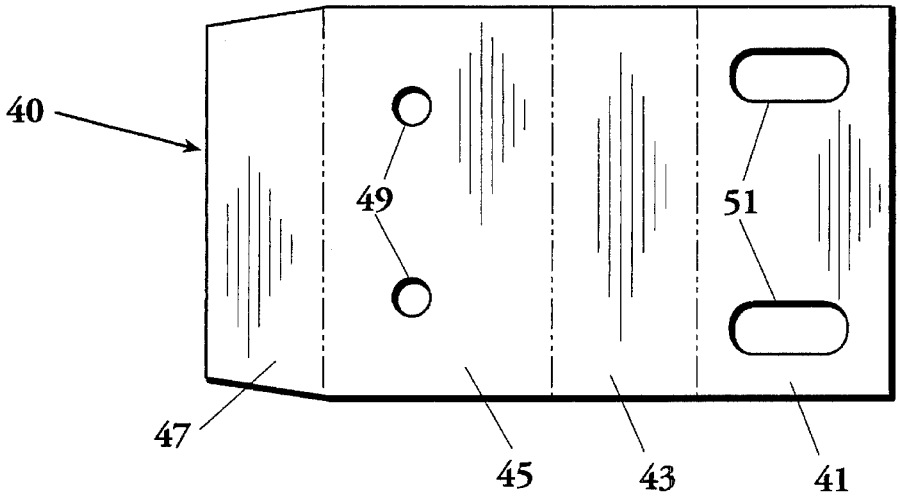
FIG. 2 is a top plan view of the light source mounting bracket prior to bending.
Figure 3:
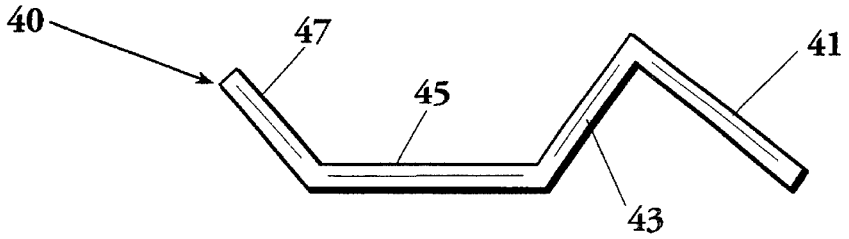
FIG. 3 is a side elevation view of the bracket of FIG. 2 after bending.

As shown in FIGS. 2 and 3, the bracket 40 is preferably formed from a strip of 14 gauge steel bent to provide a mounting portion 41 inclined at an angle to the horizontal suitable for abutment with a wall of the tower 13, a downwardly angled portion 43 extending from the mounting portion 41 to a horizontal seat portion 45 and another upwardly angled portion 47 extending upwardly from the horizontal seat portion 45. Mounting holes 49 are provided in the horizontal seat portion 45 for securing the light source 30 in place on the bracket 40 between the angled portions 43 and 47 of the bracket 40. Mounting slots 51 are provided in the mounting portion 41 of the bracket 40 so as to permit adjustable positioning of the bracket 40 by sliding the bracket 40 in relation to the tower 13.

Figure 4:
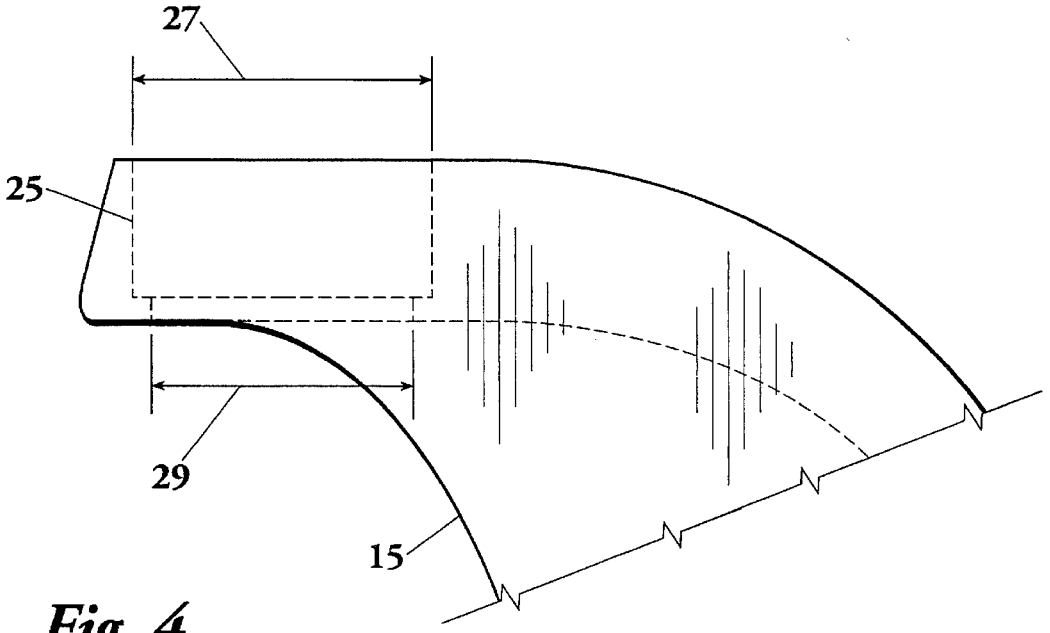
FIG. 4 is an enlarged view of the upper portion of the lens blocker tower modified to receive the lens projecting device of the present invention.

As shown in FIG. 4, the upper portion 15 of the tower 13 is provided with a eyepiece 25 having a large diameter 27 in an upper segment thereof and a smaller concentric diameter 29 in a lower segment thereof.

Figure 6:
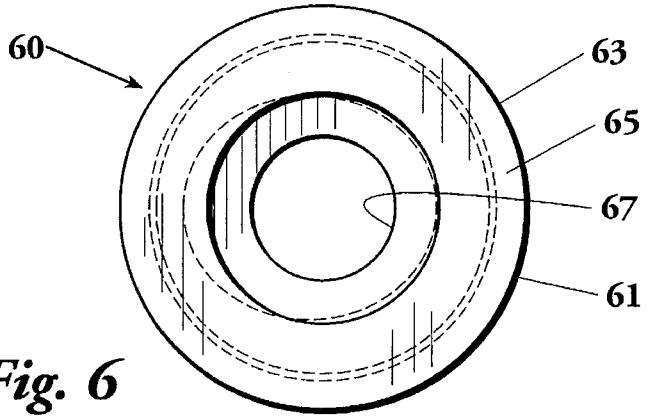
FIG. 6 is a top plan view of the viewer of FIG. 5.
Figure 5:
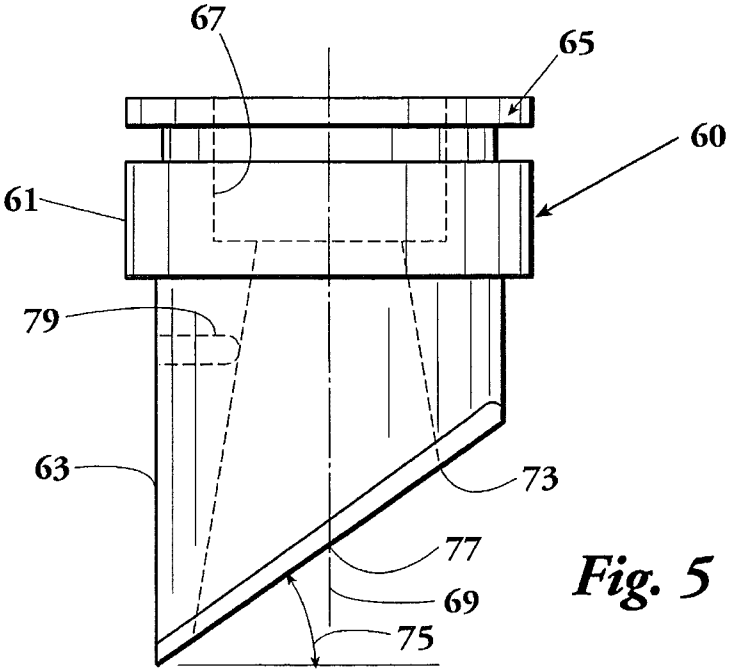
FIG. 5 is a side elevation view of the viewer of the lens projecting device.

The viewer 60 is illustrated in FIG. 5 and 6. As shown, the viewer 60 has a wide cylindrical upper body 61 and a narrower cylindrical lower body 63 so that the viewer can be seated in the eyepiece mounting hole 25 as shown in FIG. 1. An eyepiece assembly 65 is mounted above the upper body 61. The viewer 60 has an aperture 67 which is aligned on a sight axis 69 which extends through the eyepiece 25 to the target display plane 21 of the LCD 23 in a direction substantially normal to the target display plane 21. The aperture 67 extends through the narrow body portion 63 of the viewer 60 and tapers outwardly from the sight axis 69 so as to define the desired viewing area 71 on the work surface 17. The bottom portion of the viewer 60 has fixed thereacross a transmissive mirror 73 at an angle 75 such that light emitted from the center 31 of the light source 30 to the center 77 of the mirror 73 is reflected by the mirror 73 along the sight axis 69 and toward the work surface 17. This can best be seen in FIG. 1. Preferably, the mirror 73 is an approximately fifty percent transmissive mirror. As shown in FIG. 1, the light source 30 is positioned so that the mirror 73 lies at approximately a 35 degree angle in relation to the work surface 17 and to the LCD target display plane 21. The viewer 60 is also provided with an aperture 79 which extends partially into the lower body 63 of the viewer 60 so that a pin (not shown) inserted into the aperture 79 can be used to rotate the viewer 60 and the mirror 73 about the sight axis 69.

Figure 7:
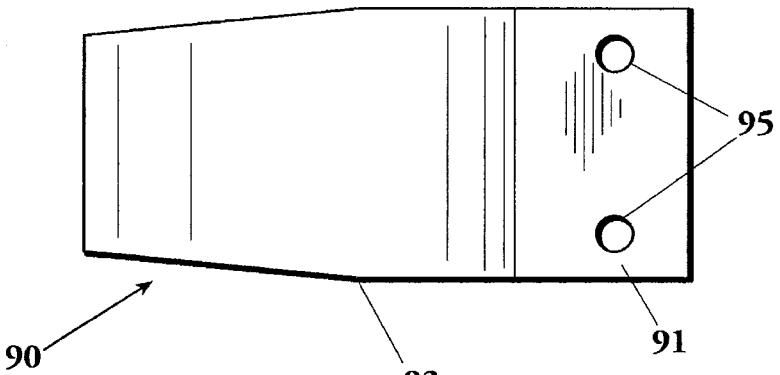
FIG. 7 is a top plan view of the heat shield of the lens projecting device.
Figure 8:
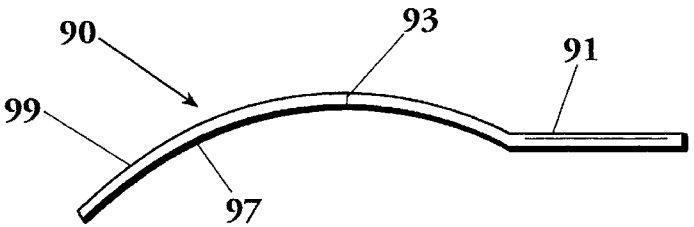
FIG. 8 is a side elevation view of the heat shield of FIG. 7.

Turning now to FIGS. 7 and 8, the heat shield 90 is illustrated. The heat shield 90 is preferably formed from 18 gauge steel and has a mounting portion 91 which extends to a shield portion 93, the shield portion 93 being curved, as shown at an arc of approximately 2.6 inches. The mounting portion 91 is provided with a pair of holes 95 which are spaced to align with the slots 51 in the bracket 40 so that the bracket 40 and heat shield 90 can be connected together at their mounting portions 41 and 91, respectively, and to the tower 13. When so mounted, as can best be seen in FIG. 1, the light source 30 is seated on the bracket 40 with the concave surface 97 of the shield portion 93 proximate the light source 30 and the convex surface 99 of the shield portion 93 proximate the wall of the tower 13.

Figure 9:
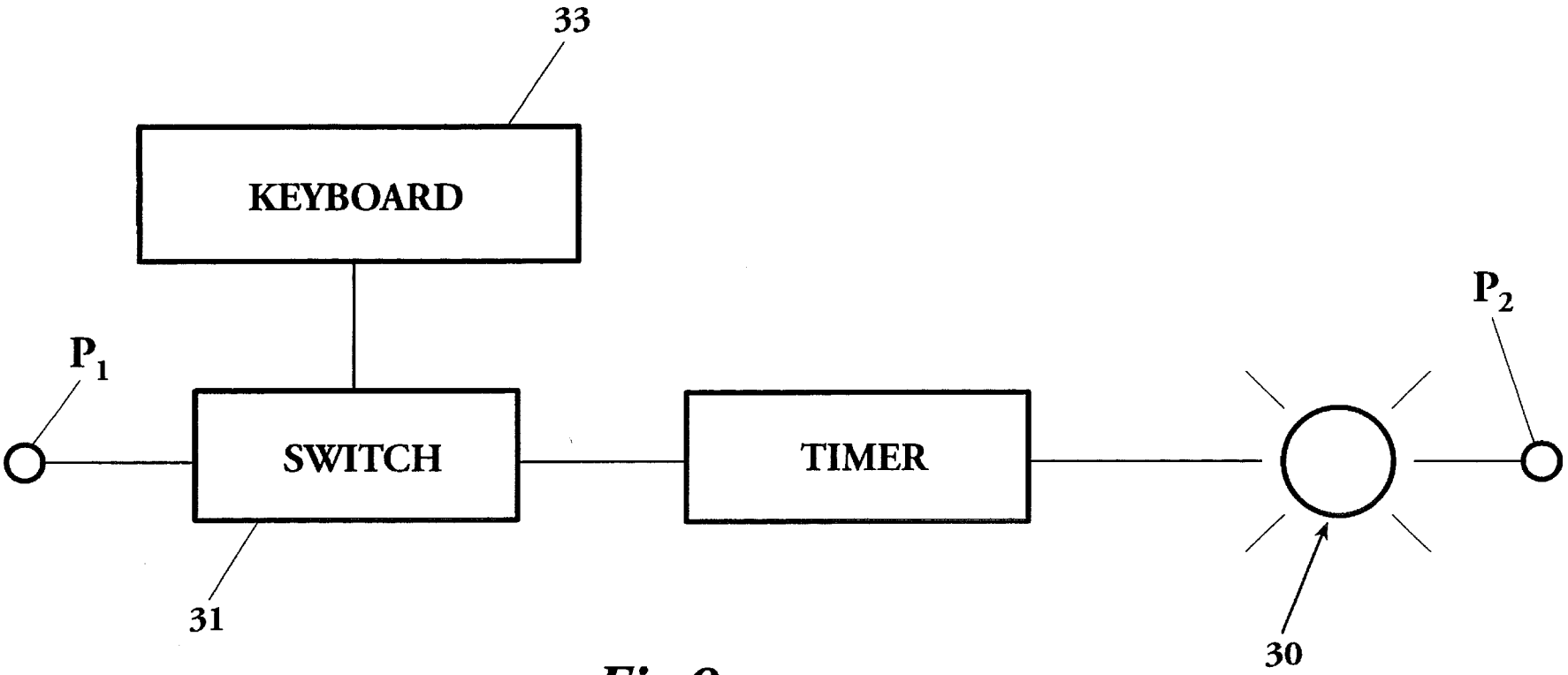
FIG. 9 is a schematic diagram of the lens projecting device control circuit.

Turning now to FIG. 9, the light source 30, which is preferably a high intensity lamp, is connected to the power source P1–P2 of the lens blocker 10. The lamp 30 is manually controlled for on-off conditions by use of a switch 31 which is controlled by operation of a preselected key on the lens blocker keyboard 33. In addition, a timer 35 is provided to automatically turn off the lamp 30 after a preselected time has elapsed. Preferably, operation of the keyboard 33 to turn on the lamp 30 will simultaneously turn off any back lighting (not shown) which may be a part of the lens blocker 10.

Since the light focused on the work area 17 is derived from a source 30 and a reflector 73 disposed above the work area, the lens L is manipulated on the upper portion of the work surface 17 and is therefore easily manipulated. In addition, since the light is directed in a path substantially normal to the work surface 17 and the LCD display plane 19, the images of the markings of the progressives and bifocals are impinged symmetrically in relation to the sight axis 69 onto the LCD display plane 21 so that the image is substantially accurate whether viewed through the viewer 60 or from any other position or angle relative to the work surface 17.

Thus it is apparent that there has been provided, in accordance with the invention, a lens projecting device that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use with a lens blocking device having an LCD target display plane disposed beneath a work surface and a tower extending above said work surface, a lens projector comprising:

a light source rigidly fixed to said tower above said work surface;

a viewer rigidly fixed to said tower above said work surface and having a sight line substantially normal to and centered on a work center of said LCD target display plane;

an at least partially transmissive mirror fixed to said viewer at an angle such that light emitted from a center of said light source is reflected along said sight line toward said work surface; and means fixed to said tower between said light source and said tower for shielding said tower from heat dissipated from said light source.

2. A projector according to claim 1, said light source comprising a lamp.

3. A projector according to claim 2, said lamp being a high intensity lamp.

4. A projector according to claim 3, said lamp being electrically connected to an electrical power source of said blocking device.

5. A projector according to claim 4 further comprising a switching means between said lamp and said power source for connecting and disconnecting said lamp to and from said power source.

6. A projector according to claim 5, said switching means being operated in response to operation of a key on a keyboard of said blocking device.

7. A projector according to claim 6, said switching means further comprising timing means for automatically disconnecting said lamp from said power source a preselected time after connection of said lamp to said power source.

8. A projector according to claim 1, said light source being proximate said mirror in relation to said work surface.

9. A projector according to claim 1, said mirror being approximately 50% transmissive.

10. A projector according to claim 1, said mirror being disposed at approximately an angle of 35 degrees in relation to said LCD target display plane.

11. For use with a lens blocking device having an LCD target display plane disposed beneath a work surface and a tower having an upper portion extending above said work surface with a eyepiece therethrough, a lens projector comprising:

a bracket fixed to said tower proximate said eyepiece;

a light source rigidly seated on said bracket above said work surface;

a viewer rigidly mounted in said eyepiece having a sight line substantially normal to and centered on a work center of said LCD target display plane;

an at least partially transmissive mirror intersecting said sight line and fixed to said viewer at an angle such that light emitted from a center of said light source is reflected along said sight line toward said work surface; and a heat shield fixed to said bracket and extending between said light source and said tower.

* * * * *